US005755349A

United States Patent [19]

Brundle

[11] Patent Number: 5,755,349

[45] Date of Patent: May 26, 1998

[54] FREIGHT CONTAINERS

[75] Inventor: Anthony Brundle, Manchester, United Kingdom

[73] Assignee: Cargo Unit Containers Ltd., Surrey, United Kingdom

[21] Appl. No.: 583,078

[22] PCT Filed: Oct. 5, 1993

[86] PCT No.: PCT/GB93/02068

§ 371 Date: Apr. 10, 1996

§ 102(e) Date: Apr. 10, 1996

[87] PCT Pub. No.: WO95/03237

PCT Pub. Date: Feb. 2, 1995

[30] Foreign Application Priority Data

Jul. 22, 1993 [GB] United Kingdom ..... 9315234

[51] Int. Cl.[6] ..... B65D 88/12

[52] U.S. Cl. ..... 220/1.5; 220/671

[58] Field of Search ..... 220/1.5, 671, 674

[56] References Cited

U.S. PATENT DOCUMENTS

| | | | |
|---|---|---|---|
| 3,306,487 | 2/1967 | Gregoire | 220/1.5 |
| 4,613,053 | 9/1986 | Kimura et al. | 220/1.5 |
| 5,069,352 | 12/1991 | Harbolt et al. . | |
| 5,154,302 | 10/1992 | Alcorn | 220/1.5 |
| 5,370,256 | 12/1994 | Fourie et al. | 220/1.5 |
| 5,395,009 | 3/1995 | Kessler et al. | 220/671 |
| 5,419,456 | 5/1995 | Graaff | 220/1.5 |
| 5,450,977 | 9/1995 | Moe | 220/1.5 |
| 5,535,907 | 7/1996 | Elvin-Jensen | 220/1.5 |

FOREIGN PATENT DOCUMENTS 0206542 12/1986 European Pat. Off. .

*Primary Examiner*—Stephen J. Castellano

*Attorney, Agent, or Firm*—Kane, Dalsimer, Sullivan, Kurucz, Levy, Eisele and Richard, LLP

[57] ABSTRACT

A freight container of generally cuboidal shape includes a pair of sides which define lateral extremities of the container and extend between ends of the container. The exterior surfaces of the pair of sides are spaced apart by a greater distance along their middle portions than along their end portions which are joined to the ends of the container, whereby the overall exterior width of the container is less at the end portions than at the middle portions. The internal width measured between the middle portions of the sides is more than 2400 mm but the overall thickness of each of the middle portions of the sides is less than 25 mm and the overall exterior width measured at the middle portions of the sides is less than 2470 mm. The container therefore has increased capacity for a given size of each end and is able to be located side-by-side with conventional container.

15 Claims, 3 Drawing Sheets

FREIGHT CONTAINERS

This invention relates to freight containers. Such containers conventionally have a respective corner fitting at each corner by means of which the containers can both be engaged by container handling apparatus when being loaded or unloaded from a wheeled vehicle or ship and be held in position on such a vehicle or ship.

In EP 0 206 542, a freight container is described that is of generally cuboidal shape including a pair of sides which define the lateral extremities of the container. Exterior surfaces of the pair of sides are spaced apart by a greater distance along their middle portions than along their end portions whereby the overall width of the container is less at the end portions than at the middle portions. With a freight container according to EP 0 206 542 the spacing of the end portions of the sides can be made such that the ends of the container can just be fitted between the cell guides of a container ship, while away from the cell guides the sides are spaced further apart and the internal width of the container can be increased. It is suggested that the difference in spacing between the middle and end portions may be in the range of 20 to 100 mm.

In a particular example of a container described and shown in EP 0 206 542 the exterior surfaces of the pair of sides are spaced apart at their ends by 2438 mm and, at their middle portions by 2500 mm allowing for an internal width of 2444 mm. Such an internal width is adequate to accommodate two metric pallets of standard size, namely 1.2 m×1.0 m, side-by-side with their major dimensions (1.2 m) extending across the container. Although notionally an internal width of 2400 mm would enable two metric pallets to be accommodated across the width in the same way, that is not feasible in practice because of tolerances and irregularities in the packing of goods on the pallets.

A container in accordance with EP 0 206 542 has proved very successful in practice because in terms of its load carrying capacity it is comparable to a container of 2500 mm overall width, yet it is able to fit in cell guides in a ship that are positioned for containers of 2438 mm width. There are, however, some occasions where the increased width of the container is a disadvantage, as will now be described. One common conventional form of container has an overall width of 2438 mm and on occasions arrangements are made to locate such containers side-by-side without leaving any space for cell guides or the like; in that case, of course, there is a problem if the container is as described above and has a maximum width of 2500 mm rather than 2438 mm. If the maximum width were reduced from 2500 mm to 2438 mm in order to try to solve that problem, then the correspondingly reduced internal width would be well below that needed to accommodate two metric pallets side-by-side with their major dimensions extending across the container.

It is an object of the invention to provide a container which overcomes or mitigates the disadvantage referred to above of the container shown and described in EP 0 206 542.

According to the invention there is provided a freight container of generally cuboidal shape including a pair of sides which define lateral extremities of the container and extend between ends of the container, the exterior surfaces of the pair of sides being spaced apart by a greater distance along their middle portions than along their end portions which are joined to the ends of the container, whereby the overall exterior width of the container is less at the end portions than at the middle portions of the sides, wherein the internal width measured between the middle portions of the sides is more than 2400 mm but the overall thickness of each of the middle portions of the sides is less than 25 mm and the overall exterior width measured at the middle portions of the sides is less than 2470 mm.

The use of such an unusually thin wall to form the middle portion of each side of the container, combined with the appreciation of certain other matters, makes it possible to overcome the problem referred to above, as will be explained below.

Preferably the thickness of each of the middle portions of the sides is about 20 mm. Although that is an exceptionally small thickness for a side wall of a freight container it could be expected that such a thickness still would not enable the problem to be overcome because either the overall exterior width would be too great or the internal width would be too small. That is especially the case since in practice the internal width measured between the middle portions of the sides is preferably more than 10 mm greater than 2400 mm and, more preferably, is 2419 mm±5 mm (i.e. in the range from 2414 mm to 2424 mm). It can readily be seen that with such an internal width and a thickness of each of the two middle portions of the sides of 20 mm, the overall exterior width measured at the middle portions of the sides will be about 2460 mm. Preferably, the overall exterior width is 2462 mm±5 mm (i.e. in the range from 2457 mm to 2467 mm). Such an exterior width is of course greater than the width of 2438 mm of a standard conventional container but we have found that such an increased width does not affect significantly the places in which the container can be put. The increase in width in the case of a container of 2462 mm overall exterior width as against a container of 2438 mm overall exterior width is only 12 mm on each side of the container. In the container industry such a small discrepancy will not generally give rise to any significant problems and there will often be an allowance made anyway for variations in the actual widths of containers from the nominal width of 2438 mm. Thus, for example, containers having an overall exterior width of 2462 mm will usually be able to be placed in spaces intended for standard conventional containers of overall exterior width 2438 mm.

Thus it will be seen that by careful choice of dimensions for the internal and overall exterior widths and by providing a container in which the overall thickness of each of the middle portions of the sides is relatively small, it is possible to provide a container which on the one hand is able to accommodate two metric pallets of standard size, namely 1.2 m×1.0 m, side-by-side with their major dimensions (1.2 m) extending across the container and on the other hand is able to be placed in all, or almost all, spaces intended for containers of standard conventional overall width of 2438 mm.

In principle, various different structural arrangements for the middle portions of the sides of the container could be used to provide the unusually thin side wall. It is, however, most preferable that the structure of the side wall can be made relatively cheaply. Preferably the middle portion of each side comprises a bottom rail member, a platform member fixed to the top of the bottom rail member and defining a substantially horizontal surface on top of the bottom rail member, and corrugated panelling the corrugated bottom of which is secured to the substantially horizontal surface defined on top of the bottom rail member. Providing a platform member that is formed separately from the bottom rail member makes it possible to provide a wider substantially horizontal surface to which the corrugated panelling can be secured. Indeed with such an arrangement the substantially horizontal surface may extend across the entire thickness of the middle portion of the side. If a top portion of the bottom rail member were simply folded to form the horizontal surface, then as a result of the relatively large radius of curvature of the bend the horizontal surface would inevitably not extend across the entire thickness of the middle portion of the side and the thickness of that portion would have to be increased to provide the same width of horizontal surface.

The platform member is preferably of inverted, substantially "L" shape with one limb extending downwardly adjacent to the top of the bottom rail member and the other limb extending substantially horizontally. In such a case, the downwardly extending limb can be positioned alongside the top of the bottom rail member and welded securely thereto.

It is advantageous for inner surfaces of the bottom rail member to be spaced apart by the minimum internal width of the container since they are then able to act as guides and buffers for pallets being loaded into the container. Accordingly, it is advantageous for the limb of the L-shaped member that extends substantially horizontally to extend outwardly from the other downwardly extending limb.

The platform member is preferably formed in an "L" shape by hot rolling. Pre-forming the platform member in an "L" shape is preferable to bending the member into the "L" shape because it is possible to avoid a large radius of curvature on the outside of the "L" where the two limbs meet.

Preferably at least one longitudinally extending rib is formed in the bottom rail member. Such a rib is able to stiffen the bottom rail member. As already indicated, the bottom rail member is preferably at the inner extremity of the side of the container and therefore the longitudinally extending rib preferably extends outwardly from the bottom rail member.

Ribs extending parallel to the corrugations are preferably provided in the corrugated panelling. Because of the unusually thin wall, the amplitude of the corrugations is unusually small and the provision of ribs extending parallel to the corrugations serves to add stiffness to the corrugated panelling. The ribs in the corrugations are much less deep than the corrugations themselves and are preferably contained within the volume defined by the other parts of the corrugated panelling.

By way of example, an embodiment of the invention will now be described with reference to the accompanying drawings, of which:

Figure 3:
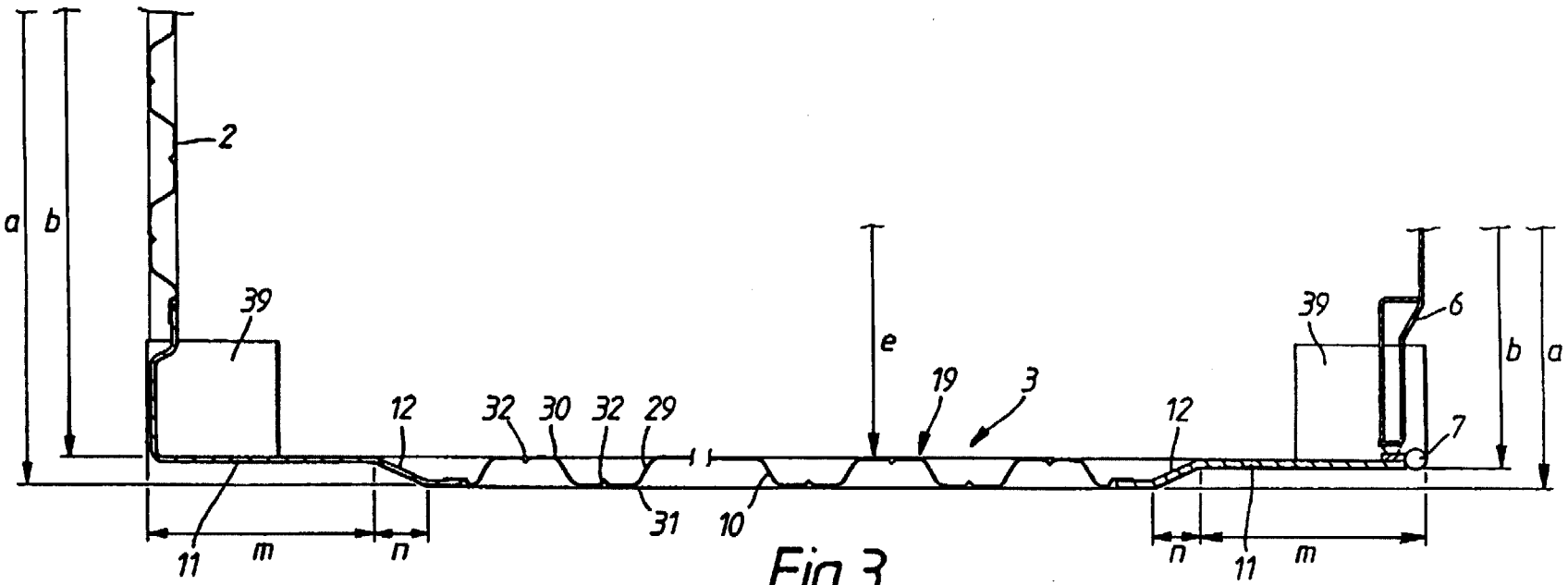
FIG. 3 is a sectional view along the lines III—III of FIG. 1 through one side of the container.

The freight container shown in the drawings is of generally cuboidal shape having ends 1, 2, sides 3, a top 4 and a bottom 5. The end 1 of the container is provided with a pair of double doors 6 mounted on hinge posts 7 (FIG. 3). The container is substantially symmetrical about a vertical plane containing the longitudinal axis of the container. Corner fittings 39 are provided at each corner of the container.

Figure 1:
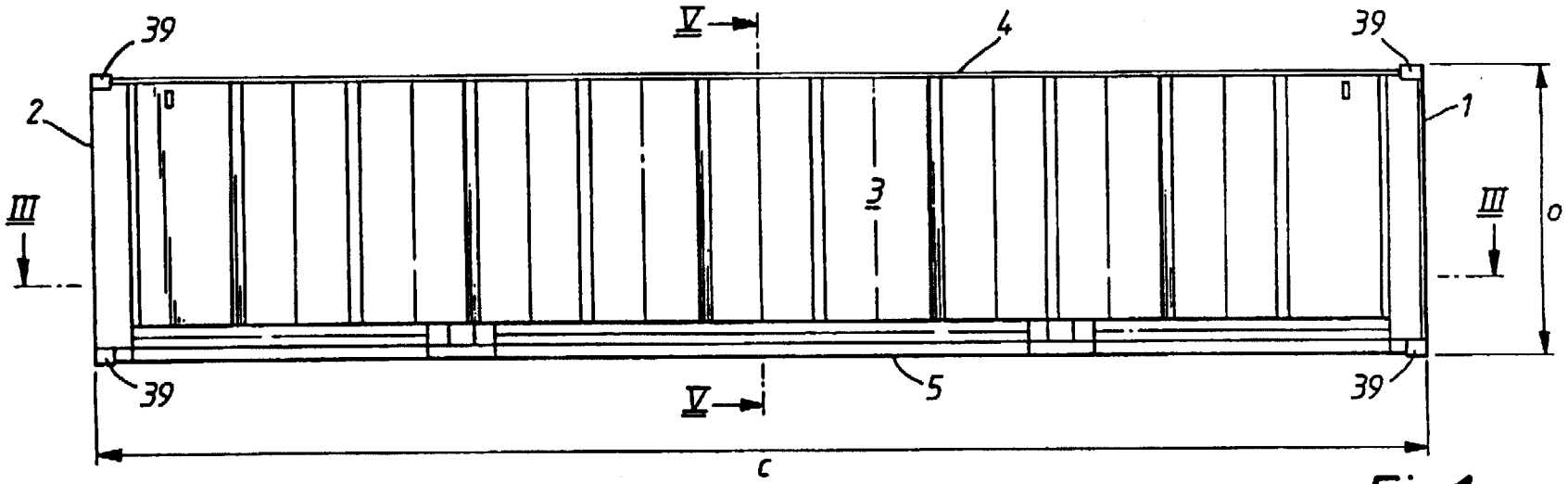
FIG. 1 is a side view of a freight container.
Figure 2:
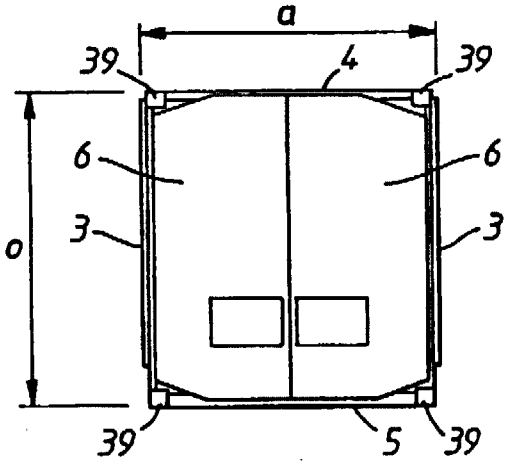
FIG. 2 is an end view of a door end of the container.

The drawings omit various details of the container in the interests of clarity and that is especially the case in FIGS. 1 to 3. The structure of most of the container is of a kind known per se and will not be described further here. The construction of each side of the container is, however, special and will be described below.

As can be seen clearly in FIG. 3, the exterior surfaces of the sides of the freight container are spaced apart by a greater distance along their middle portions 10 that are corrugated than along their end portions 11 that are not corrugated. Formed as integral extensions of the end portions 11 are interconnecting portions 12 that are inclined at an acute angle to the longitudinal axis of the container and connect the middle portions 10 to the end portions 11.

Figure 5:
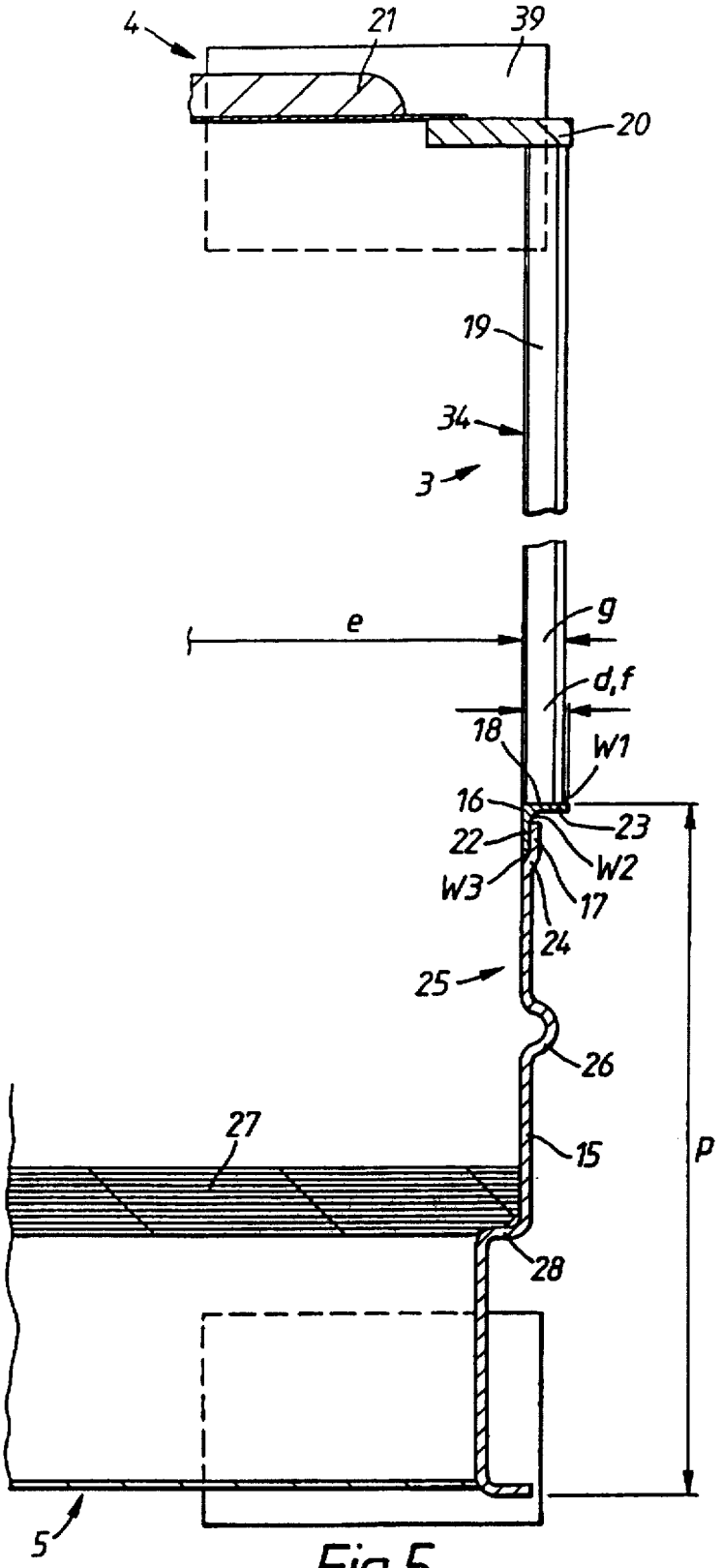
FIG. 5 is a sectional view along the lines V—V of FIG. 1 through one side of the container.

Referring now to FIG. 5, each side 3 at a middle portion comprises a bottom rail member 15, a platform member 16 fixed to the top 17 of the bottom rail member and defining a substantially horizontal surface 18 on top of the bottom rail member, and corrugated panelling 19, the corrugated bottom of which is secured to the substantially horizontal surface 18 defined on top of the bottom rail member 15. A flat bar 20 is fixed to the top of the corrugated panelling 19 and a roof 21 is in turn fixed to the flat bar. The platform member 16 is of inverted, substantially "L" shape with one limb 22 extending downwardly alongside the top 17 of the bottom rail member 15 and the other limb 23 extending substantially horizontally outwardly. The top 17 of the bottom rail member 15 is displaced outwardly by a crank 24 formed therein, for example by bending or pressing, to allow the downwardly extending limb 22 of the platform member 16 to lie inside and alongside the top 17 of the bottom rail member 15 without projecting into the interior of the container any further than other parts of the bottom rail member. The platform member 16 is formed in a "L" shape by hot rolling. In the particular example of the invention illustrated, the downwardly extending limb 22 of the platform member 16 is longer than the horizontally extending limb 23.

The corrugated panelling 19 has its interior boundary face 34 co-planar with the interior face 25 of the bottom rail member 15 and has an overall thickness slightly less than the width of the horizontal surface 18 defined by the platform member 16. Accordingly, there is a small space left on the outside of the surface 18 of the platform member 16 beyond the corrugated panelling and that enables the panelling 19 to be welded at W1 to the platform member 16 on the outside along the entire length of the panelling. A continuous weld W2 is also provided on the outside of the container between the bottom rail member 15 and the platform member 16 and a stitch weld W3 is provided on the inside of the container between the bottom of the platform member 16 and the bottom rail member 15.

The bottom rail member 15 has a rib 26 extending along the container which serves to stiffen the rail member. The rib 26 is formed by bending or pressing the bottom rail member to the desired shape.

Also shown in FIG. 5 is the container floor 27 which rests on an inwardly projecting portion 28 of the bottom rail member 15.

It should be noted in FIG. 5 that only the extreme top and bottom portions of the corrugated panelling 19 are shown. The bottom rail occupies only a very small proportion of the overall height of the container.

Figure 4:
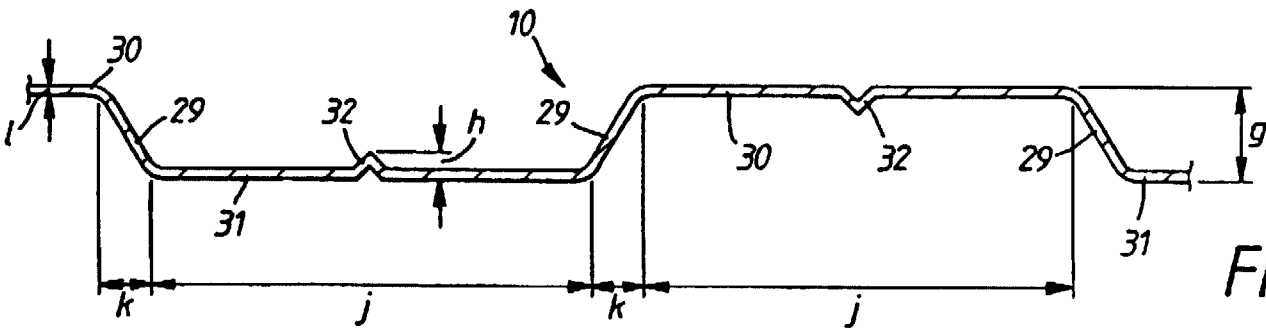
FIG. 4 is an enlarged sectional view of part of the side wall shown in FIG. 3.

Referring especially to FIG. 4 it will be seen that corrugated panelling 19 has corrugations that run vertically and comprises portions 29 sharply inclined to the longitudinal axis of the container, inner portions 30 and outer portions 31 which are parallel to the longitudinal axis of the container. Midway along each portion 30 and 31 a respective vertical rib 32 is provided. The rib 32 on an inner portion 30 projects outwardly whilst a rib 32 on an outer portion 31 projects inwardly so that the ribs are contained within the volume defined between the portions 30 and 31 of the corrugated panelling. As shown in FIG. 4 the depth of each rib 32 is much less than the overall thickness of the panelling. The ribs 32 add further strength to the panelling 19.

The bottom rail members 15 extend substantially the whole length of the container and thus extend into the end portions 11 of the container. The exterior width between the extremities of the bottom rail members 15 (i.e. the spacing between the extremities of the ribs 26) is constant along their length and is arranged to correspond to the spacing of the exterior surfaces of the sides of the container at their end portions. The corrugated panelling 19 terminates at the junction of the interconnecting portions 12 and the middle portions 10 of the container are welded to the inner surfaces of the interconnecting portions 12. The platform members 16 extend to the junction of the interconnecting portions 12 and the end portions 11, but each horizontally extending limb 23 of each platform member 16 reduces progressively in width along the length of the respective interconnecting portion 12 towards the respective end portion 11 so that the limb 23 does not project laterally unduly beyond the interconnecting portion 12 yet provides a platform for that portion.

In one particular example of the invention, the principal dimensions of the container are as follows:

| | |
|---|---|
| Overall exterior width (a) at the middle portions 10: | 2462 mm |
| Overall exterior width (b) of the end portions 11: | 2438 mm |
| Overall length (c): | 6058 mm or 12192 mm |
| Overall thickness (d) of side wall of middle portion 10: | 21.5 mm |
| Minimum internal width (e): | 2419 mm |
| Width (f) of horizontal surface 18 of platform member: | 21.5 mm |
| Overall thickness (g) of corrugated panelling 19: | 19.5 mm |
| Depth (h) of ribs 32: | 6 mm |
| Length (j) of portions 30 and 31: | 90 mm |
| Length (k) of inclined portions 29: | 10 mm |
| Thickness (1) of panelling sheet: | about 2 mm |
| Length (m) of end portions 11: | 300 mm approx. |
| Length (n) of inclined interconnecting portions 12: | 65 mm approx. |
| Overall height (o) of container: | 2591 mm |
| Height (p) of surface 18 above bottom of container: | 325 mm |

In FIGS. 3 and 5 various dimensions, for example, the minimum internal width (e), are shown which extend across the container and it should be understood that those dimensions are the dimensions measured to the corresponding point (not shown in FIG. 3 or 5) on the opposite side of the container. In each case as a result of the symmetry of the container about a vertical plane through the longitudinal axis of the container the points on each side are equispaced from that vertical plane and the construction of the side of the container not shown in FIGS. 3 and 5 is the mirror image of that shown in FIGS. 3 and 5.

In the example the minimum internal width of 2419 mm applies not only at the middle portions 10 of the container but also at its end portions 11. If desired, however, the minimum internal width at the end portions 11 could be reduced.

When loading pallets into the container the inner surface of the bottom rail member 15 provides a smooth surface of constant cross-section along the length of the container and can therefore be used by a fork-lift truck driver loading a pallet into the container as an abutment surface against which the pallet can be pressed. It will be appreciated that such a surface is preferable to a corrugated surface which, by virtue of the corrugations, varies in cross-section along the length of the container, even though the minimum spacing between the corrugations on opposite sides may be as great. Thus loading of two pallets side-by-side into the container with little space between them and the side walls of the container is facilitated.

In terms of an overall width of 2438 mm and an overall length of 6058 mm or 12192 mm, an increase in width on each side of the container of 12 mm is not great and even when arrangements are made to place conventional containers side-by-side it is common to allow a small space between them. Thus, the increased lateral projection of 12 mm will not in normal circumstances prevent such containers being placed in a space intended for a container of overall width 2438 mm.

I claim:

1. A freight container comprising:

a pair of opposite ends, a pair of opposite sides defining lateral extremities of said container and extending between said opposite ends of said container, said sides having end portions adjacent to said ends and middle portions extending between said end portions, and further having exterior surfaces that are spaced apart by a greater distance along said middle portions than along said end portions which are joined to said ends of the container, said container thereby having an overall exterior width which is less at said end portions than at said middle portions, a top, a floor, said ends, sides, top and floor together defining a box of generally cuboidal shape, and a respective corner fitting at each corner of said container, wherein the middle portion of each side comprises a bottom member which extends both downwardly below said floor and upwardly above said floor, and corrugated panelling disposed above the bottom member, the bottom member defining an upright abutment surface above the floor in the interior of the container for guiding a pallet being loaded into the container, and wherein the container has an internal width measured between said middle portions of said sides which is more than 2400 mm but an overall thickness of each of the middle portions of the sides less than 25 mm and an overall exterior width measured at said middle portions of said sides of less than 2470 mm.

2. A freight container according to claim 1, in which the overall thickness of each of the middle portions of the sides is about 20 mm.

3. A freight container according to claim 1, in which the internal width measured between the middle portions of the sides is 2419 mm±5 mm.

4. A freight container according to claim 1, in which the overall exterior width measured at the middle portions of the sides is 2462 mm±5 mm.

5. A freight container according to claim 1, in which the middle portion of each side comprises a bottom rail member, a platform member fixed to the top of the bottom rail member and defining a substantially horizontal surface on top of the bottom rail member, and corrugated panelling the corrugated bottom of which is secured to the substantially horizontal surface defined by the platform member on top of the bottom rail member.

6. A freight container according to claim 5, in which the platform member is of inverted, substantially "L" shape with one limb extending downwardly adjacent to the top of the bottom rail member and the other limb extending substantially horizontally.

7. A freight container according to claim 6, in which the limb of the L-shaped member that extends substantially horizontally extends outwardly from the other downwardly-extending limb.

8. A freight container according to claim 6, in which the platform member is formed in an "L" shape by hot rolling.

9. A freight container according to claim 5, in which at least one longitudinally extending rib is formed in the bottom rail member.

10. A freight container according to claim 9, in which said at least one longitudinally extending rib projects outwardly from the bottom rail member.

11. A freight container according to claim 1, in which the internal width of the corrugated panelling measured at the middle portions of the sides is substantially the same as the internal width between the abutment surfaces measured at the middle portions of the sides.

12. A freight container of generally cuboidal shape including a pair of sides which define lateral extremities of the container and extend between ends of the container, the exterior surfaces of the pair of sides being spaced apart by a greater distance along their middle portions than along their end portions which are joined to the ends of the container, whereby the overall exterior width of the container is less at the end portions than at the middle portions, wherein the internal width measured between the middle portions of the sides is more than 2400 mm but the overall thickness of each of the middle portions of the sides is less than 25 mm and the overall exterior width measured at the middle portions of the sides is less than 2470 mm;

the middle portion of each side comprising a bottom rail member, a platform member fixed to the top of the bottom rail member and defining a substantially horizontal surface on top of the bottom rail member, and corrugated panelling the corrugated bottom of which is secured to the substantially horizontal surface defined by the platform member on top of the bottom rail member;

further including ribs extending parallel to the corrugations provided in the corrugated panelling.

13. A freight container according to claim 12, in which the ribs in the corrugations are contained within the volume defined by the other parts of the corrugated panelling.

14. A freight container comprising:

pair of opposite ends, a pair of opposite sides defining lateral extremities of said container and extending between said opposite ends of said container, said sides having end portions adjacent to said ends and middle portions extending between said end portions, and further having exterior surfaces that are spaced apart by a greater distance along said middle portions than along said end portions which are joined to said ends of the container, said container thereby having an overall exterior width which is less at said end portions than at said middle portions, a top, a floor, said ends, sides, top and floor together defining a box of generally cuboidal shape, and a respective corner fitting at each corner of said container, wherein the middle portion of each side comprises a bottom member which extends both downwardly below said floor and upwardly above said floor, a substantially horizontal surface defined on top of said bottom member, and corrugated panelling which rests on top of and is secured to said substantially horizontal surface, and wherein the container has an internal width measured between said middle portions of said sides which is more than 2400 mm but the overall thickness of each of the middle portions of the sides is less than 25 mm and the overall exterior width measured at said middle portions of said sides is less than 2470 mm and in which the overall exterior width of the container measured at the middle portions of the sides is greater than the width measured between the exterior surfaces of the bottom member.

15. A freight container according to claim 14, in which the internal width of the corrugated panelling measured at the middle portions of the sides is substantially the same as the internal width of the bottom member measured at the middle portions of the sides.

* * * * *